United States Patent [19]

Brand et al.

[11] Patent Number: 4,760,674

[45] Date of Patent: Aug. 2, 1988

[54] APPARATUS FOR AND METHOD OF CONSTRUCTING AN IMPROVED FOUNDATION STRUCTURE

[76] Inventors: Scott R. Brand, 4605 S. Priest Rd., Tempe, Ariz. 85282; Dennis M. Duffy, 10038 N. 49th Dr., Glendale, Ariz. 85302

[21] Appl. No.: 27,626

[22] Filed: Mar. 19, 1987

Related U.S. Application Data

[63] Continuation of Ser. No. 785,441, Oct. 7, 1985, abandoned.

[51] Int. Cl.[4] ..... E02D 19/00

[52] U.S. Cl. ..... 52/169.5; 52/296; 52/297

[58] Field of Search ..... 52/169.5, 198, 302, 52/295, 169.14, 294, 310, 169.1, 742, 169.9, 296, 297; 405/229, 230

[56] References Cited

U.S. PATENT DOCUMENTS

| | | | |
|---|---|---|---|
| 3,426,487 | 2/1969 | Forte | 52/169.5 |
| 4,298,294 | 11/1981 | Zimmerman | 52/169.5 |
| 4,309,855 | 1/1982 | Pate et al. | 52/169.5 |

*Primary Examiner*—David A. Scherbel
*Assistant Examiner*—Creighton Smith
*Attorney, Agent, or Firm*—Joseph Roediger; Gregory Nelson

[57] ABSTRACT

A structural foundation for a building possessing improved stability wherein the combination of a moisture-pervious layer in contact with the soil surface and an overlying fluid gathering member are located beneath the foundation slab. The adjacent foundation footing, provided with a vertical anchoring system, includes air passages to the gathering system thereby permitting air circulation to remove moisture from beneath the slab.

3 Claims, 3 Drawing Sheets

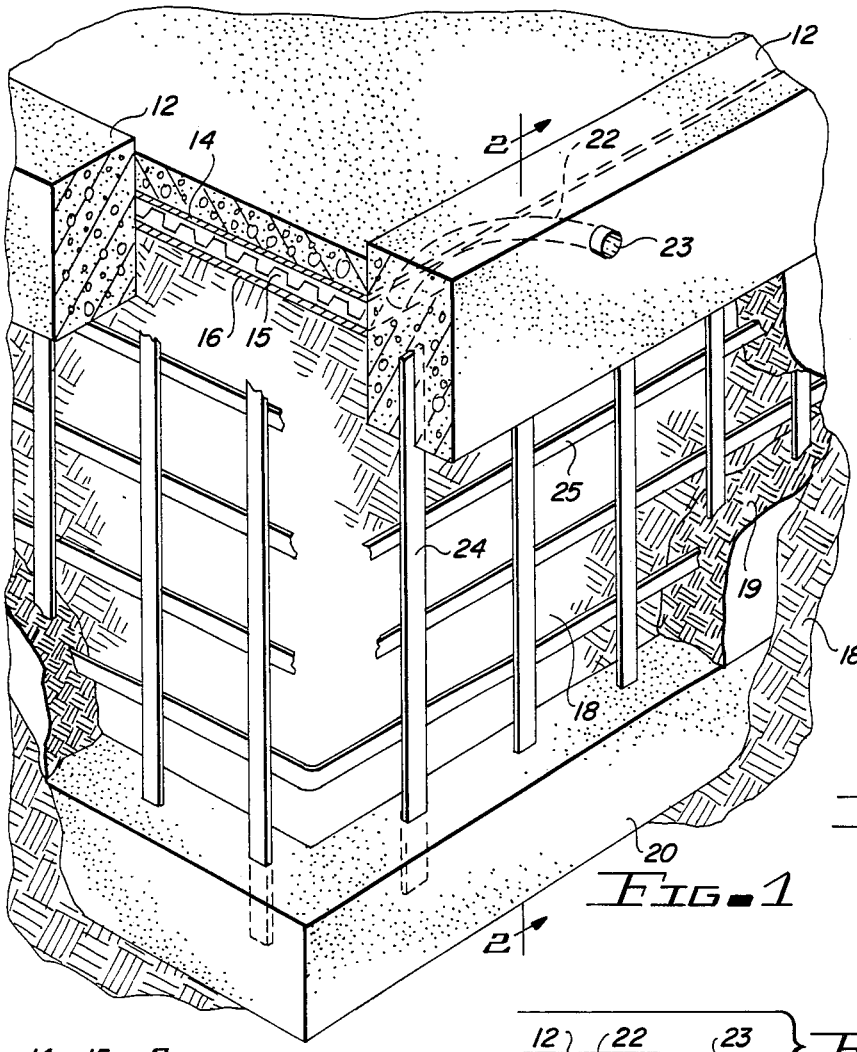
FIG. 1
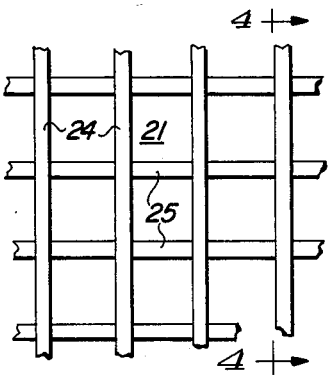
FIG. 3
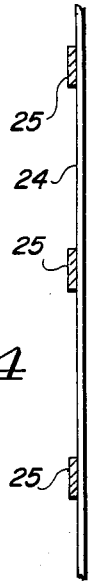
FIG. 4
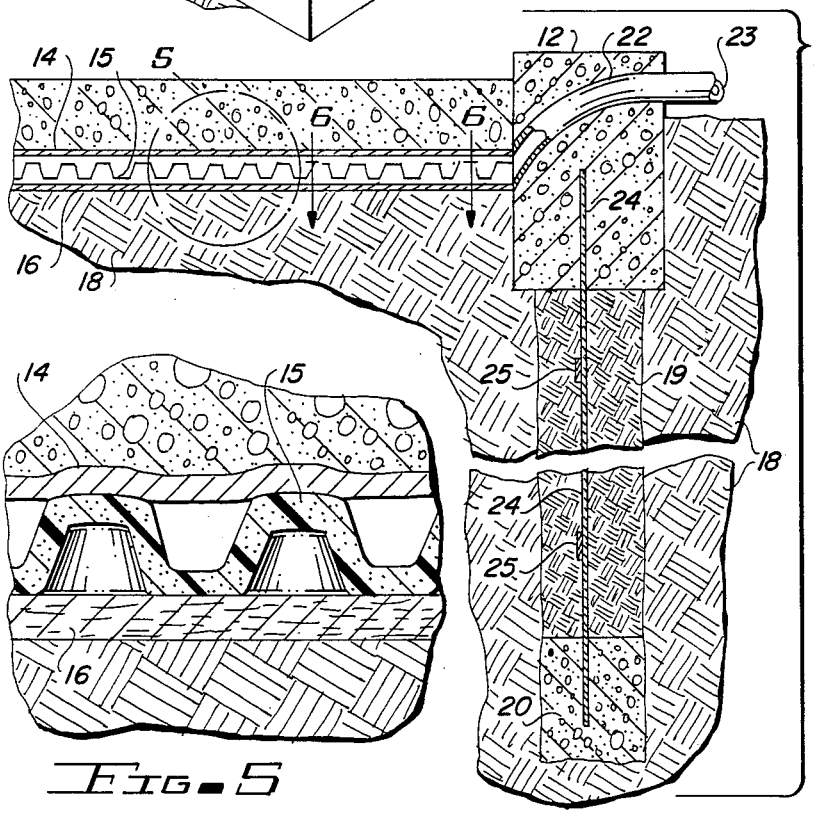
FIG. 2
FIG. 5
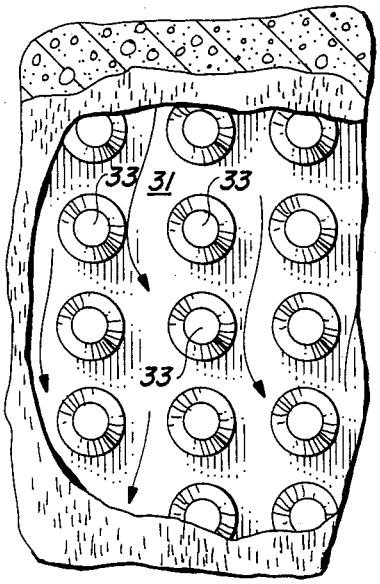
FIG. 6

FIG. 8
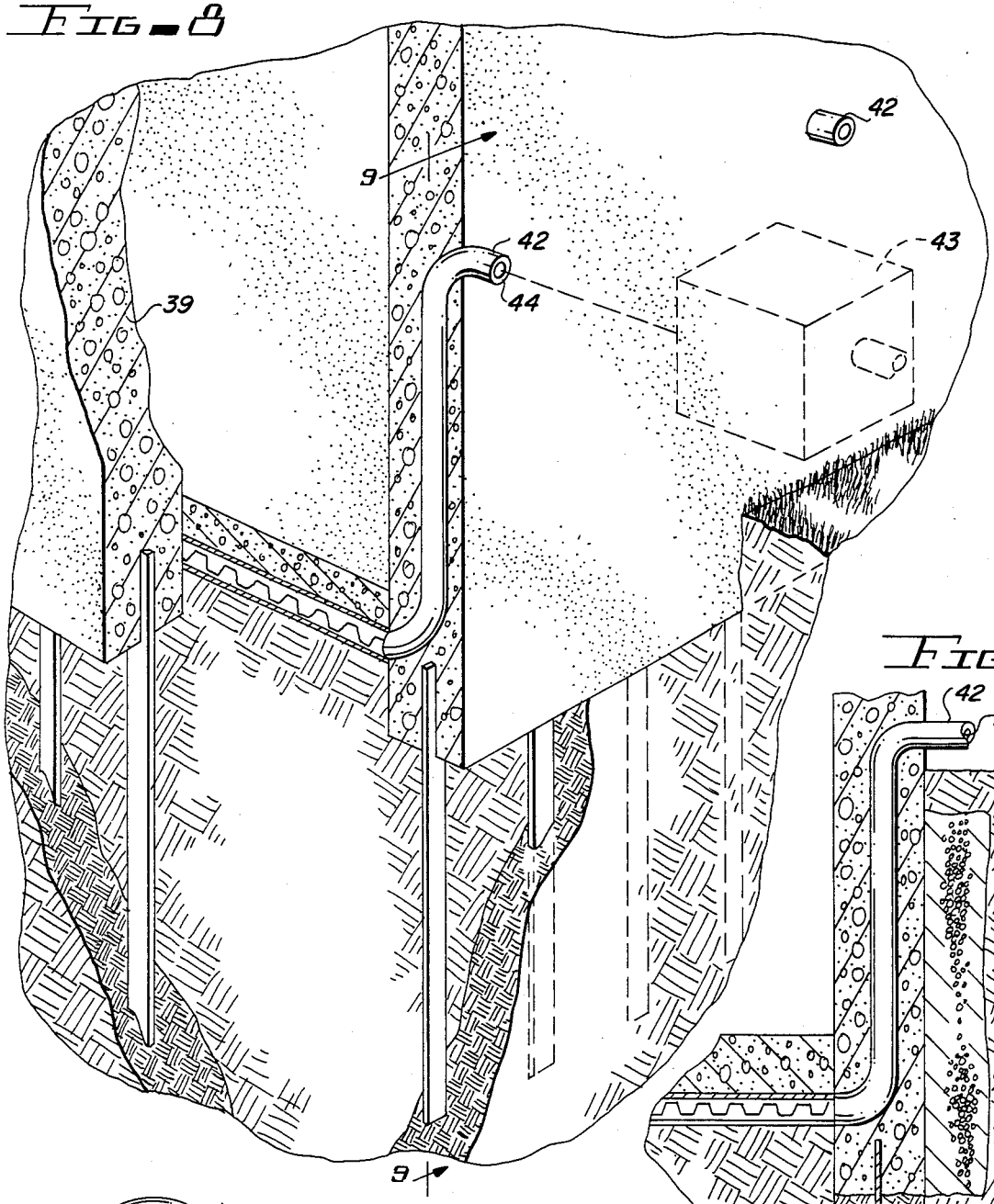
FIG. 9
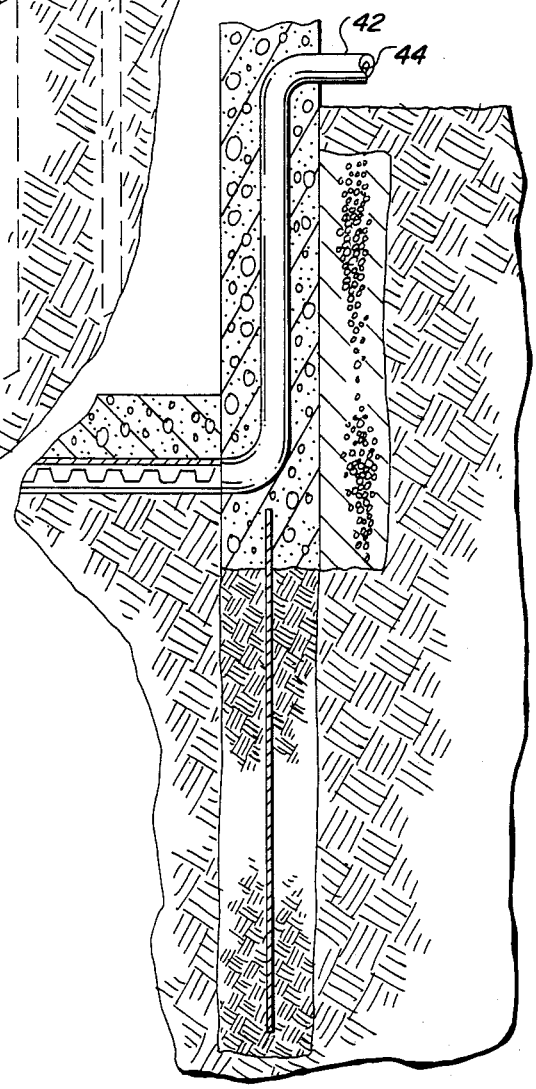
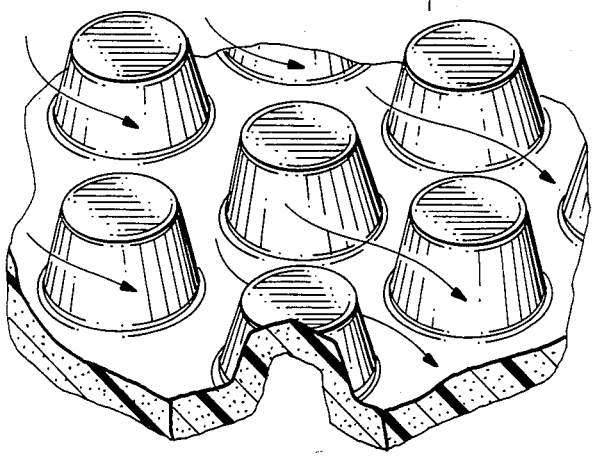
FIG. 7

APPARATUS FOR AND METHOD OF CONSTRUCTING AN IMPROVED FOUNDATION STRUCTURE

BACKGROUND OF THE INVENTION

This application is a continuing application of our copending U.S. patent application Ser. No. 06/785,441, filed Oct. 7, 1985, now abandoned.

This invention relates to apparatus for and a method of constructing a building foundation and, in particular, to a foundation structure exhibiting improved stability and resistance to soil dynamics.

A conventional small building foundation typically includes a large area slab with surrounding footings. The footings extend vertically for a limited distance into the ground below the plane of the areal slab. The slab is formed either on the soil surface or at a level therebelow for subsurface or basement construction. The footing, frequently formed as an integral part of the slab, extends downwardly therefrom to a depth specified by the builder, or engineer, as necessary in his judgment, to provide a durability over a long period of time. In practice, the foundation structure is constructed to reduce, to an acceptable level, the probability of soil damage to the structure.

Since soil varies widely in expansion characteristics, density, and moisture absorption capability, a foundation structure should be designed taking into account the character of soil in that locale. Furthermore, the precipitation rates and water table levels should also be considered since they can vary significantly from year to year or even season to season in a given location. Due to the wide variation in climatic conditions and soil types, it is too often found that the stresses on building foundations exceed initial expectations or an improbable sequence of environmental events occurs to cause resultant damage in the structure. This damage arises from increased stresses giving rise to cracking in the slab, unequal forces between the slab and the footing causing separation therefrom, relative vertical movements between footing and slab, or a tilting of a portion of the foundation structure thereby causing the entire structure to depart from the initial level condition. In any of these cases, the structure itself is likely to be damaged as well as its foundation.

One approach taken to reduce the problem of soil expansion inducing unequal stresses in a foundation structure has been to extend the footings in the vertical direction to lower soil strata. This technique is similar to the pile structures utilized in multistory buildings and increases the costs of the resultant foundation structure significantly. It also may end up in promoting increased stresses in the interface between the areal slab and adjacent footing, thereby promoting the relative movement that was to be eliminated. Since much of the undesired soil dynamics can be attributed to variations in moisture content in the regions surrounding the footing and underlying the slab, the provision of trenches along the outer surface of the footing filled with coarse material such as aggregate or gravel, along with the provision for drainage at the bottom of the trench, is frequently utilized in building construction. While this approach has reduced the water content of the gravel adjacent the footings, the gravel itself has been noted to be an excellent transmitter of stresses generated and propagated laterally from adjacent soil outside the foundation structure. This is likely to cause a tilting of the footing due to compressive stresses, or, perhaps, a buckling of the slab between the opposing footings. These problems have also been observed in attempts to utilize different materials as an underlayment to the slab portion of the foundation structure. The use of coarse aggregate in this situation frequently finds the aggregate being an excellent transmitter of vertical stress from the soil immediately underlying this layer thereby reducing the useful life of the foundation structure.

While the foregoing attempts to reduce the impact of soil expansion and induced stresses on a foundation structure have been tried with varying degrees of success throughout the country, it should be recognized that they can be successful as long as the soil condition has been properly gauged and the environmental conditions do not depart from the norm. However the fifty year event, such as an uncommonly heavy rainfall season, is likely to result in that occurrence leading to damage to the foundation structure. While prior construction practices have reduced the likelihood to a degree, frequently the homeowners activities greatly affect surface drainage and add to moisture concentrations about foundation structure, tending thereby to increase the likelihood of structural damage over a period of time.

According to the present invention, a foundation structure having improved stability is provided by the placement of a novel fluid gathering means underlying the slab along with removal means in fluid communication with the gathering means for affecting removal of the moisture through appropriate portions of the foundation structure itself. An object of the invention is to provide increased durability and stability without requiring the use of bulk materials emplaced beneath the foundation slab prior to its formation insitu. Also, the invention is directed to reducing the likelihood of relative movement between the slab and adjacent footings. The novel method of providing these results requires limited additional machine utilization, few additional bulk materials and provides an encased system for removing moisture from beneath the slab essentially during the lifetime of the construction materials used in the foundation.

SUMMARY OF THE INVENTION

According to the present invention, a structural foundation of the type including an areal slab having a perimetric footing region adjacent thereto, is provided with a moisture pervious layer located on the soil surface prior to the formation of the slab. A fluid gathering means is positioned adjacent the upper surface of the layer for receiving moisture from the soil which passes through the pervious layer. The slab is formed thereon in overlying position in the conventional manner as is the adjacent footing, typically formed as an integral structure with the slab.

The invention includes removal means coupled to the fluid gathering means and communication therewith to permit the introduction of outside air into the gathering means and the removal of the moisture therein. Thus, the perimetric footing region is provided with fluid conduction means which extend outwardly to the external environment. Air passage is promoted or urged by external drive means, through the fluid conduction means to remove the moisture gathered in the region under the slab.

The perimetric region serving as the footing is provided with engaging means which extend downwardly into the soil and frictionally engage the soil to inhibit movement in a vertical direction of the footing itself. In cases where the footing is not needed for load-bearing walls, the perimetric region may, in fact, be the outer portion of the slab with the engaging mean affixed directly to the slab. The combination of the means to remove moisture from beneath the areal slab and the engaging means for the footings comprises a novel foundation structure and method of making same. The structure formed thereon possesses enhanced stability and durability during the times that improbable environmental conditions occur.

Further features and advantages of the invention will become more readily apparent from the following detailed description of specific embodiments thereof when taken in conjunction with the accompanying drawings.

BRIEF DESCRIPTION OF THE DRAWINGS

FIG. 1 is a perspective view of an embodiment of the invention with the adjacent soil partially cutaway.

FIG. 2 is a partial cross-sectional view taken along lines 2—2 of FIG. 1.

FIGS. 3 and 4 show a plan view and sideview respectively of the engaging means utilized in the embodiment of FIG. 1.

FIG. 5 is an exploded view of the encircled portion of FIG. 2.

FIG. 6 is a partial plan view of the fluid gathering means taken in the direction of the arrows 6—6 in FIG. 2.

FIG. 7 is a view in perspective of the fluid gathering means in the inverted position as shown in FIG. 6.

FIG. 8 is a partial view in perspective of a second embodiment of the invention with the adjacent soils cutaway.

FIG. 9 is a partial cross-sectional view taken along lines 9—9 of FIG. 8.

DESCRIPTION OF THE PREFERRED EMBODIMENTS

Figure 10:
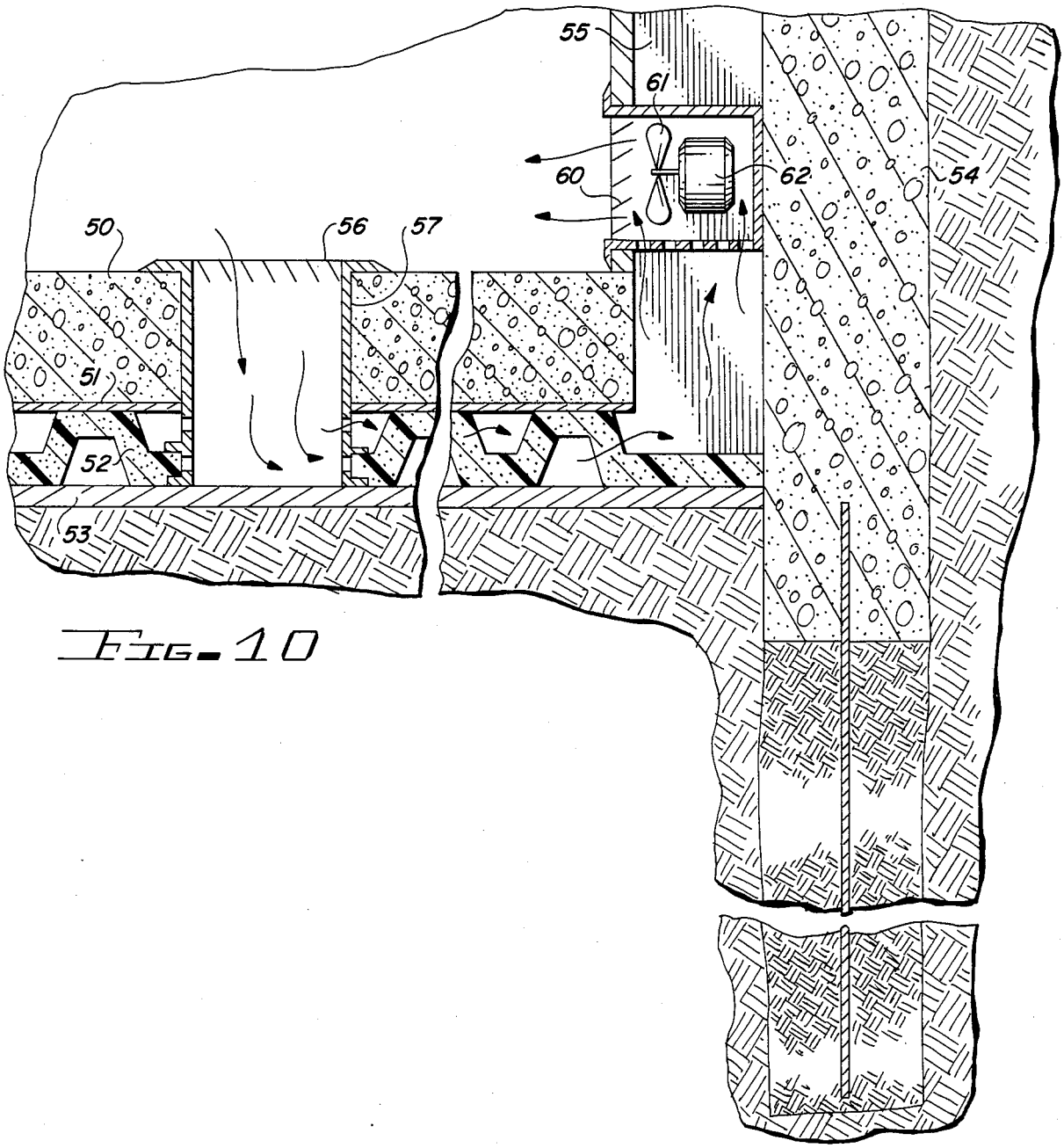
FIG. 10 is a partial cross-sectional view of another embodiment of the invention.

Referring now to FIG. 1, a foundation structure for a building constructed in accordance with the present invention is shown comprising an areal slab 11 having an adjacent perimetric footing 12 therearound. A portion of the footing region is omitted from FIG. 1 to show the region directly below the slab 11. This embodiment is directed to a foundation structure wherein the slab is formed on the leveled soil surface for a typical residential structure in contrast with an excavated embodiment wherein the foundation structure is placed at the bottom thereof.

As shown in FIGS. 1 and 2, slab 11 has three members interposed between its bottom surface and the top surface of the underlying soil. In contact with the bottom surface of the slab is a barrier layer 14, immediately therebelow is a fluid gathering means 15 and beneath that is moisture pervious layer 16. This combination of layers extends throughout the underside of slab 11 and is bounded by the footings 12 as shown more clearly in FIG. 2. The underlying soil 18 is undisturbed with the exception of surface leveling activity taking place prior to the placement of moisture pervious layer 16 thereon. However, beneath the footing region 12 is a volume of soil 19 which has been removed to permit the formation of subfooting 20. Engaging means 21 comprising vertical members 24 and horizontal members 25 is secured within the upper footings 12 and the subfooting 20. The reasons therefor will be more fully described in a later section.

In the formation of a foundation structure, prior evaluation of the surface soil characteristics is important in order to be able to determine the stresses induced by soil dynamics upon the foundation structure and the building to be formed thereon. The characteristics of this soil will determine the thickness of the slab, the thickness and depth of the footing region adjacent thereto and the depth of the subfooting formed in the trench directly under the footing adjacent the slab. In addition to soil characteristics and dynamics, the construction should take into account the environmental characteristics notably rainfall, the height variation of the water table in this region and the water retention and water percolation characteristics of this soil. All these factors will bear on the stresses induced in the foundation structure during the expected lifetime of the building. Typically, a tradeoff is made between the ability of the foundation structure to withstand certain maximum stresses and the likelihood of events taking place in this immediate area which would give rise to stresses of that magnitude. A cost factor is all important in considering the steps necessary to provide a durable long-lived foundation structure.

Turning now to FIGS. 1 and 2, the soil having been leveled to the extent necessary to accommodate a foundation slab 11 most likely formed by pouring concrete insitu. The soil surface is provided with a moisture pervious layer 16 underlying the entire areal slab to be later poured. This material is preferably a fabric filter no greater than one-quarter inch in thickness, which allows water to pass freely therethrough but limits the passage of soil grains. Both non-woven and woven drainage fabrics formed of synthetic materials are available to industry. Thickness, tensile strength, abrasion resistance are all important parameters in the selection of drainage filter fabrics and a wide variety are available on the commercial market. As a class, these products are called geotextiles. A fluid gathering means 15 is placed upon the moisture pervious layer and, as shown, has a waffle-like cross-sectional structure to define a multiplicity of generally orthogonal channels extending therefrom. These channels are in mutual communication across the entire area of the gathering means. Thus, laterally spaced elevated regions are formed on either side of the channels. Upon the upper surface of these elevated regions is placed a barrier layer 14 which serves to reduce the tendency for the poured material of the slab to enter and fill the channels therebetween. The fluid gathering means is formed from a generally moisture impervious material so that moisture migrating from the soil into the fluid gathering channels is barred from traveling upward through the barrier layer to the slab, thus, keeping the bottom surface of the slab relatively moisture free.

The fluid gathering means is preferably formed from a flexible plastic sheet being run at elevated temperatures between a series of roller dies to form the channeled structure. The barrier layer placed on the elevated region of the fluid gathering means is preferably a relatively thin plastic layer having limited elasticity. In practice, the weight per unit area of the poured slab is relatively low and the barrier layer is subject only to limited deflection due to the weight of the poured concrete. The actual pouring, moving and leveling of the slab during formation are more likely to result in concrete being worked down into the channels, thus, suggesting that the barrier layer be utilized in most embodiments. However, in circumstances where the slab is either preformed or formed in a manner in which the working of the material is limited, barrier layer 14 may be omitted.

After the underlayment layers and the slab are placed in the desired area, fluid conduction means 22 is provided to establish a means for access to the external environment. In FIGS. 1 and 2, a conduit 22 is shown provided in footing 12 and extends thereacross to provide an external coupling 23. This conduction means is utilized during the lifetime of the foundation structure to permit the passage of air therethrough and the consequent removal of moisture in the gaseous state from the fluid gathering means. A plurality of conduction means at spaced locations in the footing to communicate with the fluid gathering means is preferred. The passage of air therethrough results in the evaporation of moisture from the fluid gathering means and its resultant removal from beneath the slab. As a result, the soil region beneath the slab is continually subjected to a drying effect thereby reducing the tendency of this soil to expand due to high moisture content. In addition, the impact of low temperatures for long periods is reduced since the soil is no longer saturated there and the effects of expansion due to freezing of the moisture contained in the soil is substantially reduced. This results in reduced stresses being placed upon the slab.

The adjacent footing region 12 has beneath it a series of laterally spaced vertical members 24 which extend downwardly into a subfooting 20. The vertical members are tied together in grid pattern by horizontal members 25. This type of grid structure formed of polyester bands is commercially available and is utilized today for slope reinforcement wherein the grid is disposed in a horizontal plane and has its free ends aligned along the slope. The grid frictionally engages the soil that is adjacent to it thereby providing trench stability. In this application, the lower ends of the grid are formed into the subfooting and extend upwardly to the bottom of the perimetric footing region of the slab. In applications wherein a separate footing region is not provided for the slab, the grid may be tied directly to the slab underside. The particular footing arrangement depends upon the architects use of the slab and whether it is in a load bearing location but the principle of support remain the same.

The subfooting is formed in a trench by pouring concrete therein and the lower ends of the grid are embedded therein. Next, the trench is backfilled to the desired depth as shown by the hatched soil 19. The perimetric footing region 12 is formed thereon and surrounds the upper ends of the grid structure. The engaging means limits vertical movement of the perimetric footing region due to increased stress levels exerted by the underlying soils.

While a subfooting 20 and a grid engaging means 21 is shown in the preferred embodiment of FIG. 1, in certain applications neither the subfooting 20 nor the grid structure 21 need be employed and a series of vertically depending flexible straps extending down to the desired depth provide sufficient frictional engagement with the soil.

In FIGS. 5 and 6, the fluid gathering means and adjacent layers are shown in greater detail. The soil 18 at the site, having been leveled and compacted, if desired, has the geotextile moisture pervious material laid thereon with the channel forming layer placed thereon. The channel 31 is adjacent the moisture pervious layer 16 and as shown in FIG. 6, carries the air urged therethrough by the external means to cause evaporation of the moisture contained therein. The elevated regions 33 support the barrier layer 14 and form the depressions 32 underlying the barrier layer 14. Since the fluid gatherin means 15 is impervious to moisture, the barrier layer 14 does not serve to limit the passage of moisture thereacross, but is provided as a protective measure towards undue deformation of the fluid gathering means and a resultant flatening of some of the channels 31 which might occur when the concrete is worked to provide the slab. While barrier 14 is utilized in a preferred embodiment, it is to be recognized that the depressions 32 can be filled by the slab forming material without effecting the operation of the invention as shown. A perspective view in FIG. 7 shows the underside of the fluid gathering means with the arrows indicating the air passage thereacross. The structural element that forms the fluid gathering means need not be formed by the die stamping process, but may have greater thickness and the depressions 32 may, in fact, be filled with material. In that case, the need for a barrier layer is obviated.

Another embodiment of the invention utilized in a sublevel foundation system is shown in FIGS. 8 and 9. It is to be noted that the barrier layer utilized in the prior embodiment has been omitted and that the grid-like engaging means has been replaced with vertical straps extending down to the subfooting. Prior to the pouring of slab 36 in the excavation, the moisture pervious layer is placed thereon with the fluid gathering means extending thereover. The slab is then formed directly upon the fluid gathering means. The adjacent footing means 39 is provided with a pair of conduits 42 which enter at the base of the footing and extend upwardly to the surface environment. One such conduction means is coupled to a means for urging air circulation 43 therethrough. This air circulation means might be a fan or perhaps a venturi-effect outlet extending upwardly along the chimney for the building. To further assist in the reduction of stresses placed upon the foundation structure, a trench 44 is formed along the outer surface of the footing region and the subsurface wall extending therefrom. The trench contains a plurality of lightweight stress relieving elements. In one embodiment of the invention, these stress relieving elements were an expanded plastic bead placed within the trench and overlaid with sufficient soil to permit cultivation along the edge of the foundation of plant material. The combination of vertical stress resistance provided by the soil engaging straps 41 and the horizontal stress relief provided by the beads in trench 44 have been found to reduce the stresses induced by the expansion of soil without the foundation structure. The combination of the slab underlayment layers and the soil engaging elements for the adjacent footing region have substantially eliminated the soil expansive stresses induced in the slab and in the slabfooting interface.

In FIG. 10, an embodiment of the invention is shown wherein a foundation structure for use in a subsurface setting is provided with removal means for effecting removal of moisture in fluid gathering means 52 by promoting the circulation of air within the structure.

Thus, moisture is then introduced into the building formed on the foundation.

As shown, the combination of barrier 51, fluid gathering means 52 and moisture pervious layer 53 are located between the areal slab 50 and the soil.

The footing 54 for the subsurface wall is provided with an interior wall 55 including louvered receptacle 60 at its foot. The receptacle is open at the bottom end and extends downwardly through the slab, barrier and into the communicating channels of gathering means 52. A fan 61 driven by motor 62 is contained within receptacle 60 which is provided with a louvered front wall. Also, a plurality of vertical passages 56 is located in the slab with the sidewalls 57 extending downwardly to the communicating channels. Thus, the circulation pattern for this embodiment is kept within the building by means of the first and second receptables extending downwardly through the slab to the fluid gathering means. The fan can be actuated manually or may be coupled to a humidity sensor located in the fluid gathering means and responsive thereto.

Figure 11:
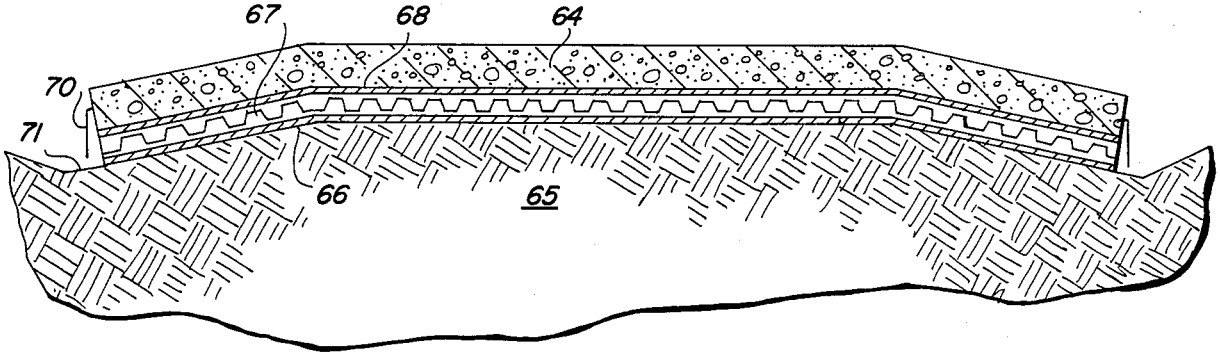
FIG. 11 is a cross-sectional view of a crowned area slab constructed in accordance with the invention.

Another embodiment of the invention is shown in FIG. 11 in connection with the placement of a crowned carport or driveway slab 64 on a base of preformed soil 65. The crowning of the soil 65 is shown extending laterally beyond the edges of the slab to form downward gradient shoulder regions 71. The combination of pervious layer 66, the channel forming member 67 gathering the moisture and the barrier layer 68 are located on the central region of the crown and the slab 64 is formed thereon. In practice, the use of flexible snow shield members 70 are advised if the climate so requires in that location.

The fluid removal in this embodiment utilizes the combination of the elevational gradient established by the crowned soil and the shoulder regions 71 to thereby insure that the exposed edges of the fluid gathering means 66 are in fluid communication with the external environment. Moisture gathered therein is removed by means of the sloped shoulder region adjacent to the edge of the gathering means and by air movement through the moisture gathering region.

While the foregoing description has referred to specific embodiments of the invention, it is recognized that many modifications and variations may be made therein without departing from the scope of the invention as claimed.

What is claimed is:

1. A system for reducing the expansive effects of unsaturated subsurface soil underlying large area foundation structures due to variation in moisture content, which comprises:

(a) a horizontal pervious layer placed upon the surface of the soil for the passage of vapor phase moisture therethrough;

(b) a horizontal impervious channel member placed in contact with said pervious layer, said channel member including a multiplicity of spaced elevated regions forming a corresponding multiplicity of horizontal communicating channels therebelow;

(c) a horizontal areal slab located in contact with and supported by said multiplicity of spaced elevated regions;

(d) removal means for circulating air from without said soil in said horizontal communicating channels and thereby removing vapor phase moisture therefrom, said means reducing the moisture content in the horizontal region of the unsaturated soil adjacent said pervious layer to thereby reduce the expansive effects of said soil on the slab; and (e) a perimetric footing adjacent said slab and extending into said soil below the channel member, said footing located adjacent the horizontal channels of said channel member whereby said channels terminate at said footing and said removal means extends through the foundation structure to an external environment above the soil surface.

2. the invention of claim 1 wherein said removal means comprises a plurality of spaced conduits, each conduit connected between the horizontal channels of said channel member and the external environment above the soil surface.

3. The invention of claim 2 further comprising means connected to said removal means for urging the flow of air through said conduits.

* * * * *